United States Patent [19]

Sumi et al.

[11] Patent Number: 4,662,966

[45] Date of Patent: May 5, 1987

[54] APPARATUS FOR TRANSFER PRINTING

[75] Inventors: Takao Sumi; Takashi Matoba; Kouichirou Shimamoto; Yoshihide Inako, all of Kyoto, Japan

[73] Assignee: Nissha Printing Co. Ltd., Kyoto, Japan

[21] Appl. No.: 654,127

[22] Filed: Sep. 25, 1984

[51] Int. Cl.[4] ..... B41F 1/28; B44C 31/00; B65C 1/00; D06P 1/00

[52] U.S. Cl. ..... 156/230; 156/309.9; 156/541; 156/380.9; 8/471; 101/407 BP

[58] Field of Search ..... 156/541, 540, 539, 583.8, 156/583.9, 583.3, 380.9, 382, 381, 387, 475, 499, 493, 488, 230, 359, 240, 309.9, 321, 322; 101/211, 407 BP; 8/471, 468

[56] References Cited

U.S. PATENT DOCUMENTS

| | | | |
|---|---|---|---|
| 3,818,823 | 6/1974 | Bond | 156/230 |
| 3,945,879 | 3/1976 | Fletcher et al. . | |
| 3,974,014 | 8/1976 | Meisner | 156/322 |
| 4,033,030 | 7/1977 | Robinson et al. | 156/230 |
| 4,097,629 | 6/1978 | Schneider | 156/359 |
| 4,174,250 | 11/1979 | Durand | 100/211 |
| 4,475,458 | 10/1984 | Kennell et al. | 101/407 BP |

*Primary Examiner*—David Simmons
*Assistant Examiner*—Louis Falasco
*Attorney, Agent, or Firm*—Fidelman, Wolffe & Waldron

[57] ABSTRACT

A transfer printing machine in which the articles to be transfer-printed are held in a holder made of a material which does not substantially expand when heated and the articles are heated by an infrared radiation heater to a predetermined temperature. A transfer sheet having symbols and/or designs formed thereon with thermo-diffusible dye is pressed by a pressing pad against the surface of the articles so that the symbols and/or designs are transfer-printed on the surfaces of the heated articles.

18 Claims, 32 Drawing Figures

APPARATUS FOR TRANSFER PRINTING

BACKGROUND OF THE INVENTION

This invention generally relates to transfer printing and more particularly to a machine for transfer printing figures, letters, other symbols or designs on plastic articles such as molded plastic key caps for business-machine and other typwriter-like keyboards.

There is disclosed in Japanese Patent Applications No. 57-145291 a method of transfer printing figures, letters and/or other symbols accurately and precisely at required positions on the surfaces of molded plastic articles by a simple process and in such a manner that the transfer-printed image on the plastic surface remains highly resistive to abrasion and/or scratching. This method employs a transfer sheet which comprises a substrate and a pattern layer formed thereon with thermo-diffusible colorants. The pattern comprises one or more figures, letters, other symbols or designs or a combination thereof, which will be referred to as a pattern or image when necessary for simplicity of description.

According to this method, molded plastic articles each having a surface to be transfer-printed are arranged in any array and heated to a predetermined temperature, and a transfer sheet is placed over the array, with the pattern layer of the transfer sheet being in contact with the surfaces of the articles to be transfer-printed. Then a pad having a plurality of projections made of elastic material and each having a curved outer surface is pressed against the transfer sheet so as to bring the pattern layer thereon into closer contact with the surface of the articles so that the images on the transfer sheet are transferred onto the surfaces of the articles, whereupon the pad and then the transfer sheet are removed from on the articles.

The above method has proved to be particularly useful in transfer printing on articles such as molded plastic key caps for the keyboards of typewriters or other business machines, which requires accurate positioning of the transfer sheet relative to the articles for transfer printing.

For carrying out the above-mentioned method, however, it has been impossible to use various known printing machines as they are chiefly for the following reasons. In the above-mentioned transfer printing method, the articles to be transfer-printed must be heated before a transfer sheet is placed on the surfaces of the articles to be transfer-printed. With the conventional machine, when the articles to be transfer-printed are heated, the frame or holder in which the articles are set or supported is also heated at the same time and thermally expands so that the articles held therein are displaced from the originally set positions and it becomes impossible to bring the pattern on the transfer sheet into accurate registration with the surface of the articles to be transfer-printed.

Accordingly, the primary object of the invention is to provide a transfer printing machine which is capable of conducting transfer printing accurately and efficiently.

Another object of the invention is to provide such a transfer printing machine as aforesaid which is capable of transfer printing figures, letters and/or other symbols or designs on a plurality of articles, particularly molded plastic objects such as key caps for typewriters or the like business machines simultaneously in a single shot without intolerable displacement of the printed images from their proper position on the articles.

The invention will be described in detail with reference to the accompanying drawings.

SUMMARY OF THE INVENTION

Briefly stated, in accordance with the invention there is provided a transfer printing machine in which the articles to be transfer printed such as molded plastic key caps for the keyboards of typewriters or like business machines are held in a holder made of a material which does not substantially expand when heated. The articles are heated by an infared radiation heater to a predetermined temperature. The holder with the heated articles therein is then held at a predetermined position, and a transfer sheet having letters, figures and/or other symbols or designs formed thereon with thermo-diffusible dye is held above the heated articles with each of the images on the transfer sheet in proper registration with the surface of the corresponding one of the articles, and then a pressing pad is pressed against the transfer sheet so that the diffusion dye constituting the images on the transfer sheet sublimates into the surface of the articles to reproduce the images on the surface of the articles. The used transfer sheet is then removed from on the articles and discarded.

DESCRIPTION OF THE PREFERRED EMBODIMENTS

Figure 1:
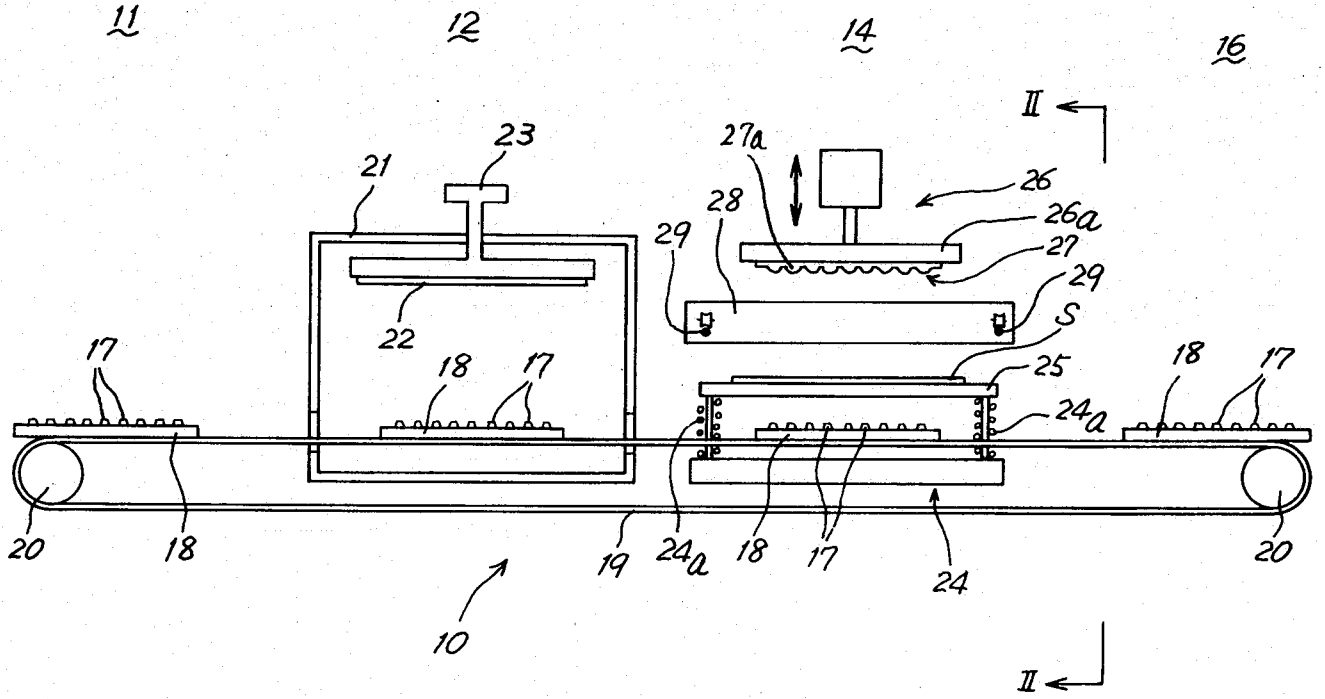
FIG. 1 schematically shows a transfer printing machine in one embodiment of the invention.
Figure 2:
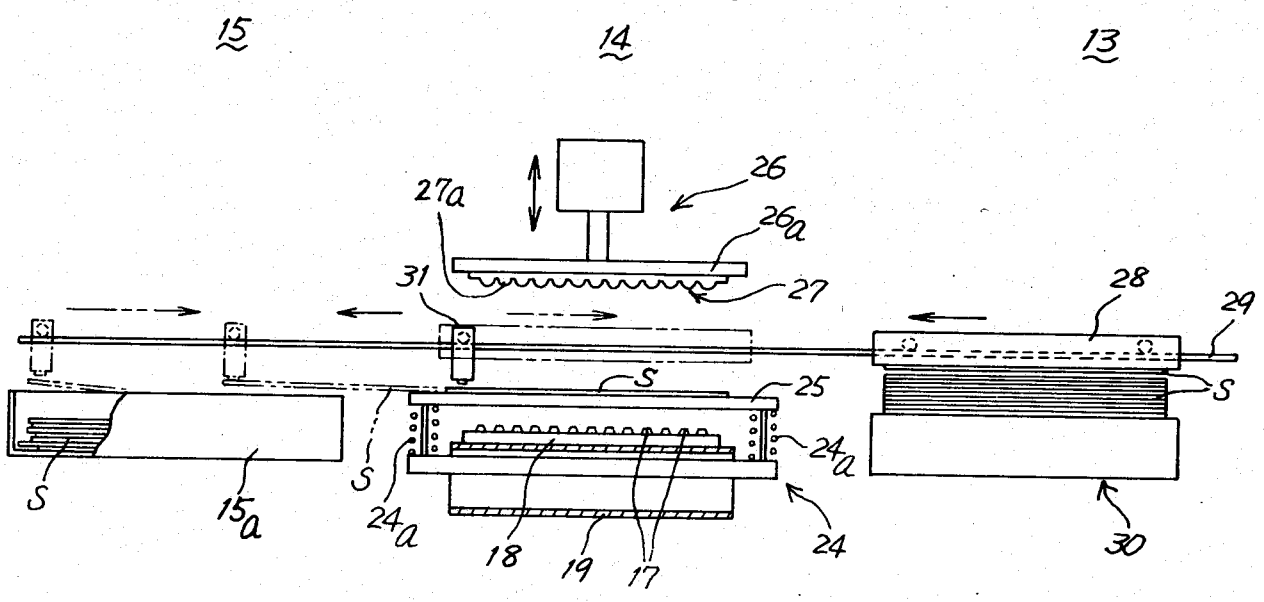
FIG. 2 is a view taken along line II—II in FIG. 1.

FIGS. 1 and 2 schematically show a transfer printing machine 10 constructed in accordance with the invention. In the following description the articles to be transfer-printed are supposed to be key caps for the keyboards of typewriters or the like.

The machine 10 comprises an article loading section 11, a heating section 12, a transfer sheet feeding section 13, a printing section 14, a transfer sheet discharging section 15 and an article unloading section 16.

A plurality, say, 50 to 200 blank key caps 17 to be transfer-printed are set in a frame or holder 18. The holder is made of a material which does not substantially expand when heated, or a material which does not absorb infrared radiation or which has a very low thermal expansion coefficient so that during the course of printing the key caps are held in proper registration with the pattern on the transfer wheet to be transferred onto the key caps.

The material of the holder 18 may be selected from aluminum, copper, other metals plated with chromium, and ceramics. The surface of the holder, if it is made of a metal, is preferably polished to provide a highly reflective surface.

An endless belt conveyor 19 extends between the article loading section 11 and the article unloading section 16 with the heating section 12 and the printing section 14 being interposed therebetween. The belt 19 is trained about a plurality of rollers, only two of which are shown as at 20. One of the rollers 20 is driven by a suitable drive not shown in a predetermined timed sequence so as to bring the holder 18 with the key caps 17 therein to the heating section 12, where the conveyor 19 stops for a predetermined period of time or slows down for heating the key caps to a predetermined temperature. Then the conveyor 19 brings the holder 18 to the printing section 14 and again stops there for transfer printing to be performed on the heated key caps and then carries them to the unloading section 16.

The heating section 12 comprises a housing 21 through which the conveyor 19 passes and a heating device 22 the height of which above the conveyor 19 is adjustable by means of a handle 23 provided outside the housing 21. The heating device 22 produces infrared radiation having a wavelength of about 1.5 μm to 1 mm, preferably, 3 μm to 50 μm.

The temperature to which the blank key caps 17 are heated can be adjusted by changing the time the key caps are heated, that is, the time they are held in the heating section 12, or by changing the temperature of the heater 22, or by changing the height or distance between the heater 22 and the key caps 17 by means of the handle 23.

The interior wall surface of the housing 21 is preferably made of a material which reflects infrared rays so as to cause the key caps 17 to absorb the heat produced by the heater 22 for efficient use of the heat energy and enable uniform heating of all the key caps. The interior wall surface of the housing 21 may be made of the same material as the key cap holder 18.

After the heating step, the conveyor 19 carries the holder 18 with the heated blank key caps therein to the printing section 14 and stops there for transfer printing to be effected in a manner to be described in detail later. The printing section 14 comprises a transfer sheet supporting device 24 including a frame 25 disposed above the conveyor 19 for suppoting a transfer sheet S and a pressing device 26 including a pad 27 disposed above the frame 25 so as to be pressed down against the key caps 17.

As shown in FIG. 2, the transfer sheet feeding section 13 comprises a transfer sheet carrier 28 and a device 30 for supplying a transfer sheet S to the carrier 28. The carrier 28 is supported by a pair of guide rails 29 extending horizontally over the conveyor 19 perpendicularly thereto, so that the carrier 28 is movable between a position above the frame 25 of the transfer sheet supporting device 24 and a position above the transfer sheet supplying device 30. The carrier 28 picks up a transfer sheet S with its pattern side facing downward from a stack of transfer sheets S on the supplier 30 by means of suction and carries the sheet to the position above the frame 25 and then releases the sheet to be placed on the frame 25, which holds the transfer sheet S with its pattern side down in proper position by means of a suitable device which may, for example, be a mechanical clamper or a suctioning device not shown but incorporated in the frame 25.

When the key cap holder 18 carried by the conveyor 19 reaches the printing section 14, the conveyor 19 stops for a predetermind period of time, so that a suitable positioning device positions the holder 18 and the key caps 17 therein in proper registration with the pattern of the transfer sheet on the frame 25. The positioning device may employ either a mechanical stopper or a photoelectric detector.

When the transfer sheet S and the holder 18 with the key caps 17 therein are positioned in proper registration with each other, the pressing device 26 is operated to lower the pad 27 as far as the mounting plate **26*a* of the pad 27 pushes the frame 25 of the transfer sheet supporting device 24 downwardly against the resiliency of springs 24*a*, with the pad 27 pressing the pattern side of the transfer sheet S against the top surface of the key caps 17 to be transfer-printed. The pad 27 is made of a suitable material such as silicone rubber and formed with a plurality of projections 27*a* each having a convexly curved under surface generally complementary with the corresponding top surface, if concavely curved, of each key cap 17. The pad 27 is provided with as many such projections 27*a* as there are key caps 17 to be transfer-printed. The pad 27 is removable from the mounting plate 26*a*** for replacement by another pad having a different configuration or projections arranged in a different pattern corresponding to the shape, configuration or arrangement of the articles to be transfer-printed.

As the image side of the transfer sheet is pressed against the surfaces of the blank key caps which have been heated to a required temperature, the thermo-diffusible dye or dyes that form the pattern or image on the transfer sheet are transferred by the heat in the key caps to the surfaces of the key caps so as to accurately reproduce the pattern or image thereon.

The transfer sheet may comprise a substrate layer and a pattern layer comprising letters, figures and/or other symbols or designs formed on the substrate layer with thermo-diffusible dye. The transfer sheet may also comprise a substrate layer, a releasable layer formed on the substrate, a pattern layer formed on the releasable layer and comprising letters, figures and/or other symbols or designs, and an adhesive layer formed on the pattern layer.

When the former type of transfer sheet is used, the thermodiffusible dye is transferred to the surface of each key cap by the heat stored in the key cap previously heated in the heating section 12, with the dye particles sublimating into the surface of the key cap to reproduce the original image thereon. It is not necessary to heat the transfer sheet or the key caps again in the printing section 14. If the temperature of the heated key caps is below the required level, it is necessary to provide the pad 27 with a heater to apply heat to the transfer sheet when pressed against the surfaces of the key caps.

When the sublimation transfer of the dye has been completed, the pad 27 is raised, whereupon the frame 25 supporting the transfer sheet S is also raised from on the surfaces of the key caps 17 thereby to prevent the transfer sheet from contacting the key caps again to smear the printed surfaces thereof.

To remove the used transfer sheet from on the frame 25, the carrier 28 for supplying a new transfer sheet may be used in such a manner that the carrier 28 picks up the transfer sheet S from on the frame 25 by suction and carries the sheet to the discharging section 15 provided on the side of the printing section 14 opposite the transfer sheet feeding section 13 and then releases the sheet to drop into a receptacle 15*a*.

In order to improve the working efficiency of the machine, a separate device 31 for removing the used transfer sheet from on the frame 25 is provided. The remover 31 is supported by the previously mentioned guide rails 29 so as to be movable between a position above the frame 25 in the printing section 14 and a position above the receptacle 15*a* in the discharging section 15. The remover 31 picks up the sheet S from on the frame 25 by suction and carries the sheet away to release it into the receptacle 15*a*.

FIGS. 3 through 26 show in more concrete form a machine constructed in accordance with the invention, with the same reference numerals or symbols as in FIGS. 1 and 2 designating the corresponding parts or members.

Figure 3:
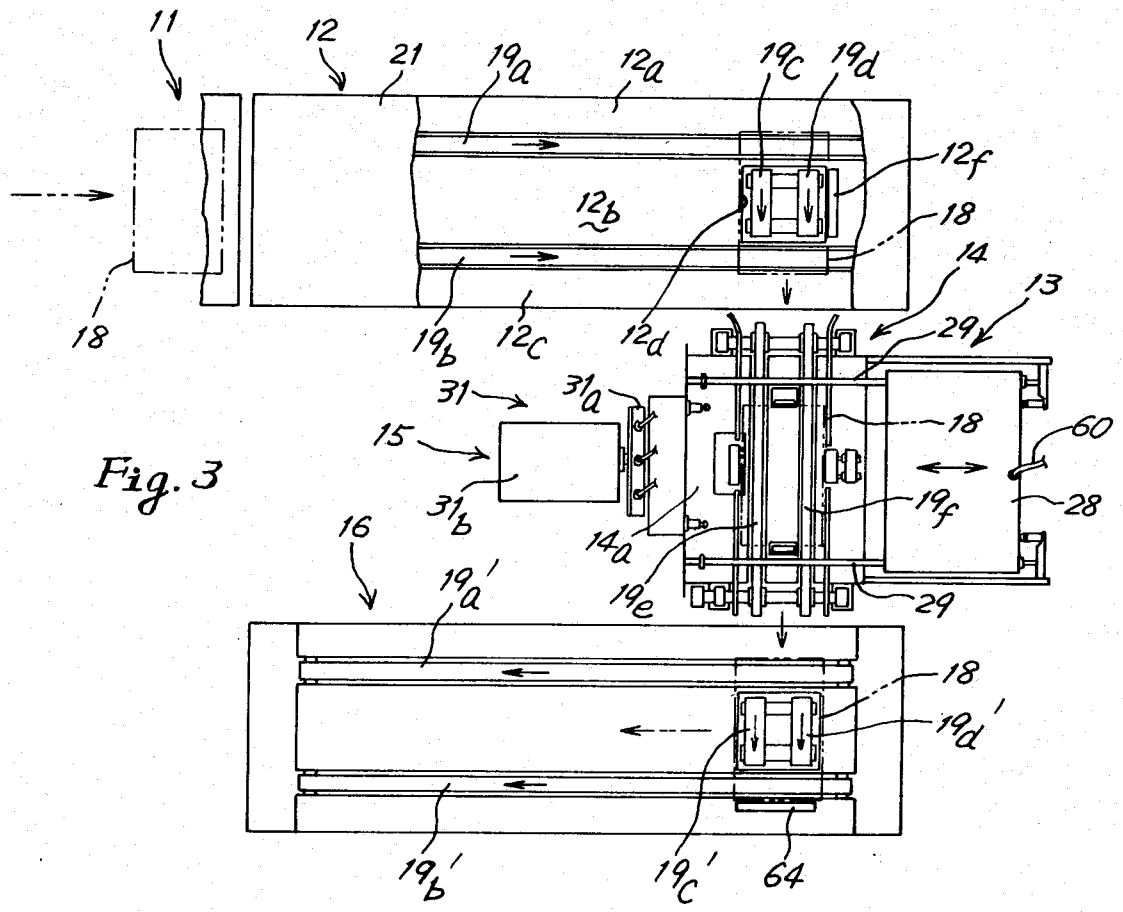
FIG. 3 is a top plan view, partially cut away, of a transfer printing machine in another embodiment of the invention.

As shown in FIG. 3, the heating section 12 and the article unloading section 16 are arranged in parallel with each other, with the printing section 14, the transfer sheet feeding section 13 and the transfer sheet discharging section 15 being interposed between the heating section and the article unloading section. The article loading section 11 is partially shown at the left side of the heating section 12.

Inside the housing 21 of the heating section 12 there are provided three horizontal support plates 12*a*, 12*b* and 12*c* extending in parallel with each other, with a pair of endless conveyor belts 19*a* and 19*b* interposed between the support plates 12*a* and 12*b* and between the support plates 12*b* and 12*c*. At the right end of the heating section 12 there are provided a pair of endless conveyor belts 19*c* and 19*d* in an opening 12*d* formed in the support plate 12*b*. The belts 19*c* and 19*d* extend horizontally in the direction perpendicular to the direction of the belts 19*a* and 19*b* and are vertically movable by means of a suitable raising and lowering device such as a pneumatic cylinder 12*e* (FIG. 4) between an upper position where the upper surface of the belts 19*c* and 19*d* are raised slightly above the upper surface of the belts 19*a* and 19*b* and a lower position where the belts 19*c* and 19*d* are lowered below the upper surface of the belts 19*a* and 19*b*. A stopper 12*f* is provided on the support plate 12*b* at the right side of the belt 19*d*.

Figure 4:
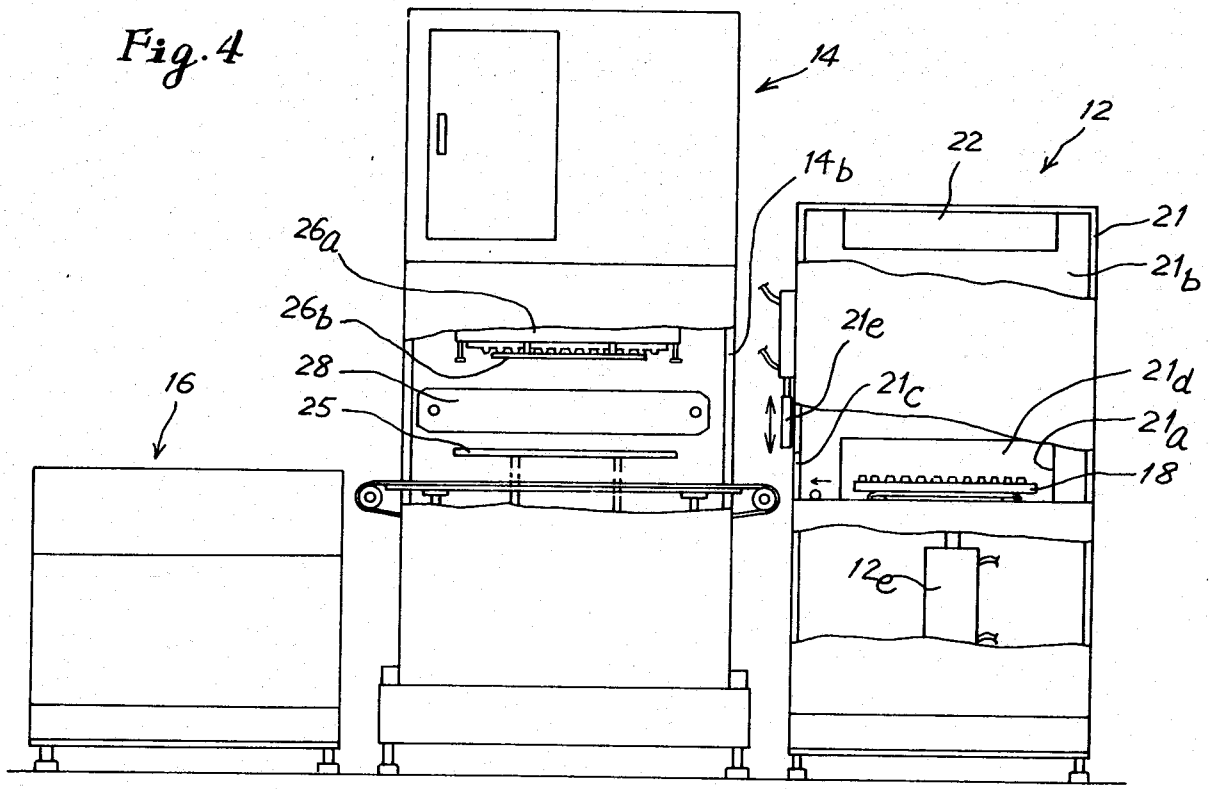
FIG. 4 is a slightly enlarged front view, partially cut away, of the machine as viewed from the right side in FIG. 3.

The key cap holder 18 with blank key caps 17 therein is introduced into the housing 21 through an inlet opening 21*a* formed in the front end wall 21*b* thereof (as shown in FIG. 4) and carried by the belts 19*a* and 19*b* through the housing 21 and stopped by the stopper 12*f* (FIG. 3), whereupon the belts 19*c* and 19*d* are raised to the upper position and carry the key cap holder 18 laterally to the printing section 14 through an outlet opening 21*c* (FIG. 4) in the side wall of the housing. The infrared radiation heater 22 provided on the ceiling of the housing 21 heats the key caps 17 in the holder 18 as they are carried through the housing 21. An inlet shutter 21*d* and an outlet shutter 21*e* are prferably provided on the inlet opening 21*a* and the outlet opening 21*c*, respectively (FIG. 4).

In the printing section 14 a horizontal support plate 14*a* is secured to a machine frame or housing 14*b* at much the same height or level as the level of the support plates 12*a*, 12*b* and 12*c* in the heating section 12.

Figure 12:
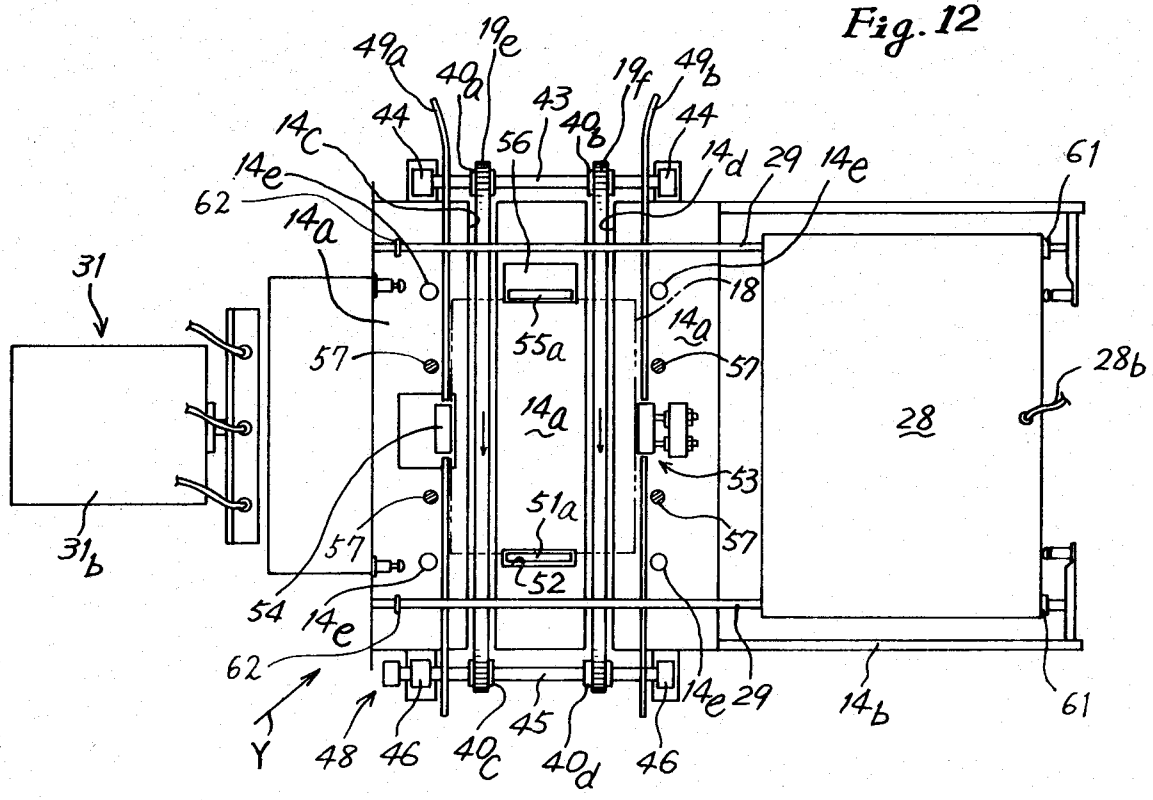
FIG. 12 is an enlarged plan view taken along line XII—XII in FIG. 5, with the frame for holding the transfer sheet being not shown for simplicity of illustration.
Figure 13:
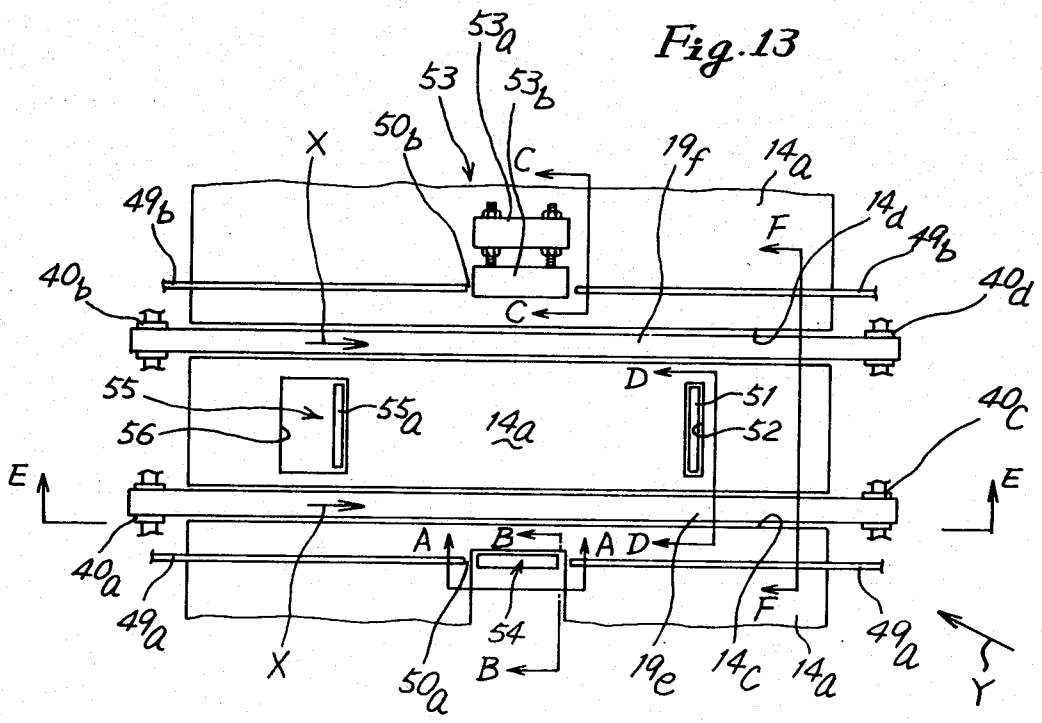
FIG. 13 is an enlarged view of the printing section shown in FIG. 12.
Figure 14:
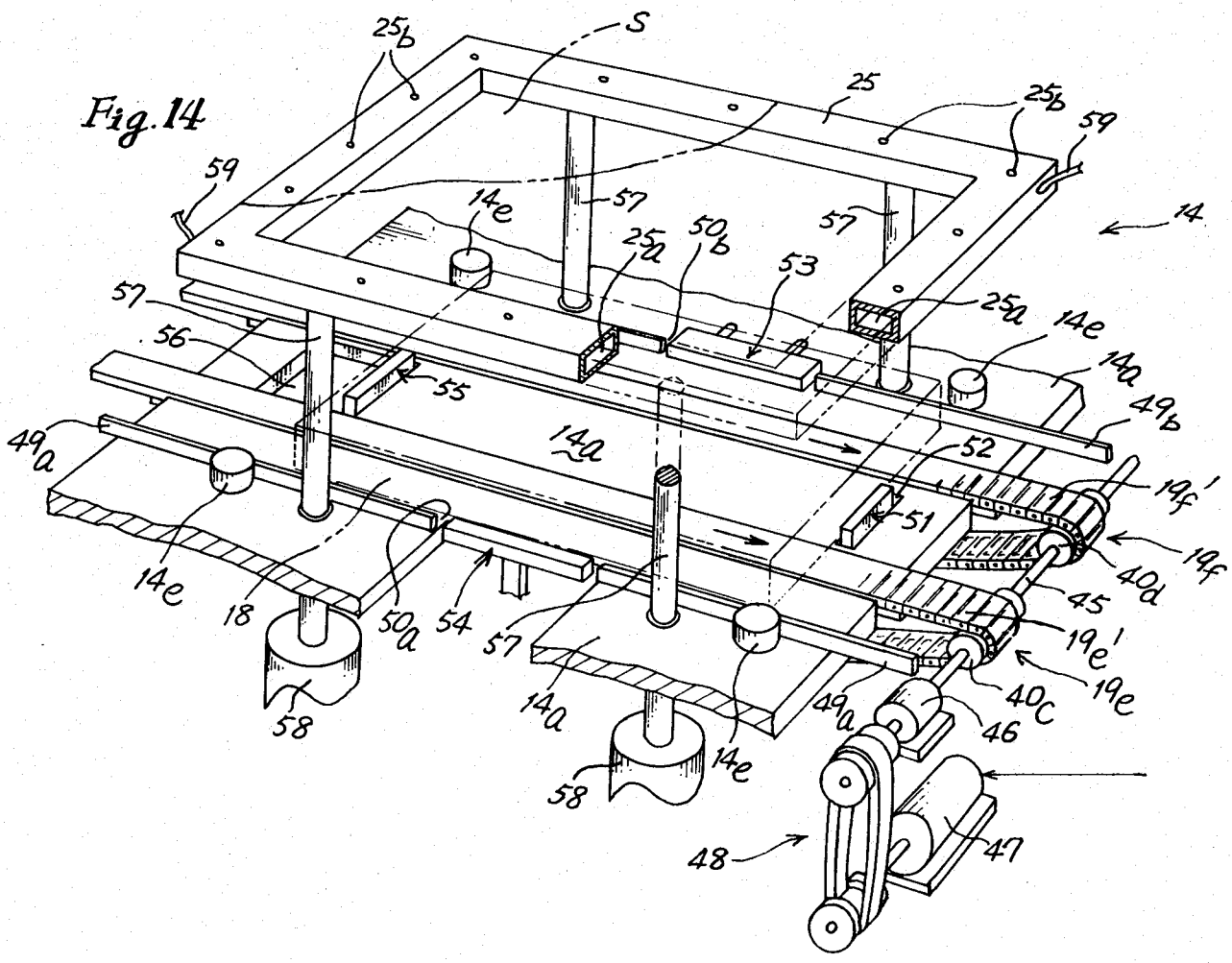
FIG. 14 is a perspective view as viewed in the direction of the arrow Y in FIGS. 12 and 13.

The support plate 14*a* is formed with a pair of parallel slots 14*c* and 14*d* which extend in general alignment with the conveyor belts 19*c* and 19*d* in the heating section 12. A pair of endless conveyor chains 19*e* and 19*f* are trained about two pairs of sprocket wheels 40*a*, 40*b* and 40*c*, 40*d* so that the upper horizontal portions 19*e*′ and 19*f*′ of the chains 19*e* and 19*f* are disposed in the slots 14*c* and 14*d*, respectively (FIGS. 12 to 14). The chains 19*e* and 19*f* and the sprocket wheels 40*a* to 40*d* are shown like belts and rollers for simplicity of illustration. Belts and rollers may also be used instead of the chains and sprocket wheels.

Figure 19:
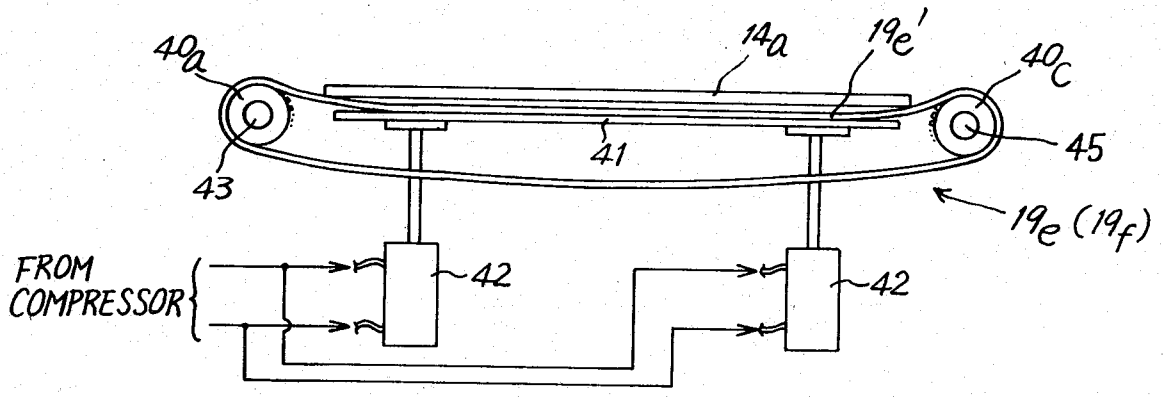
Figure 20:
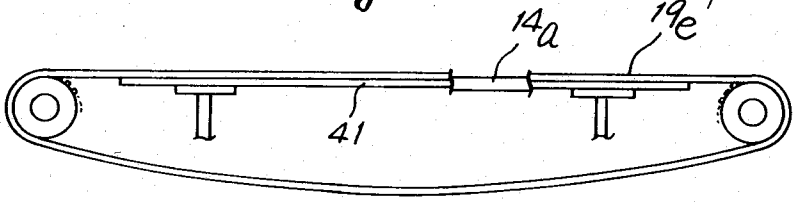

Each of the upper horizontal chain portions 19*e*′ and 19*f*′ is supported by a horizontal tensioning plate 41 (FIGS. 19 and 20) which can be vertically moved by a pair of pneumatic cylinders 42 fixed to the machine frame so that the chain protions 19*e*′ and 19*f*′ are vertically movable between an upper and a lower position. In the upper position the upper chain portions 19*e*′ and 19*f*′ are slightly above the upper surface of the horizontal support plate 14*a* as shown in FIG. 20 and are tensioned so that the chains 19*e* and 19*f* can be moved in the manner to be described presently. In the lower position, however, the upper chain portions 19*e*′ and 19*f*′ are slackened to a level slightly below the horizontal support plate 14*a* as shown in FIG. 19.

The sprocket wheels 40*a* and 40*b* are fixed to a shaft 43 journaled at its opposite ends in bearings 44 secured to the machine frame at one side of the support plate 14*a* and the sprocket wheels 40*c* and 40*d* are fixed to a shaft 45 parallel with the shaft 43 and journaled at its opposite ends in bearings 46 secured to the machine frame at the opposite side of the support plate 14*a*. The shaft 45 is driven by a motor 47 shown in FIG. 14 through a belt-and-pulley connection 48.

A pair of parallel guide rails 49*a* and 49*b* are provided on the support plate 14*a* laterally outside the slots 14*c* and 14*b*, respectively (FIGS. 12 to 14). Each guide rail is divided into two longitudinal half sections, which are longitudinally separated by an intermediate space 50*a*, 50*b* for the purpose to be described later.

Figure 18:
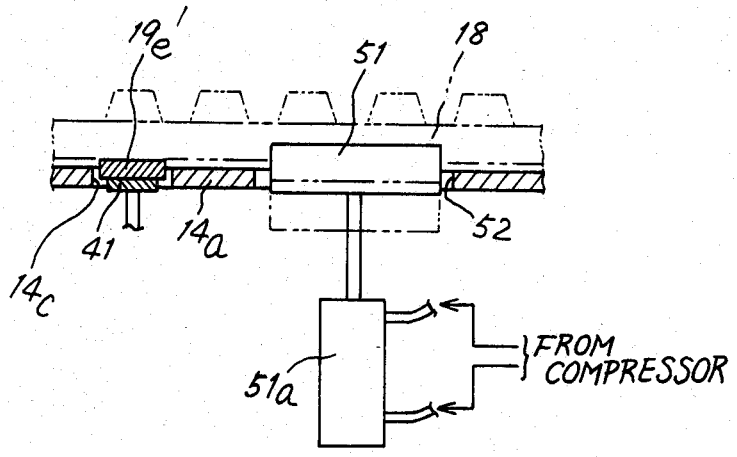
Figure 21:
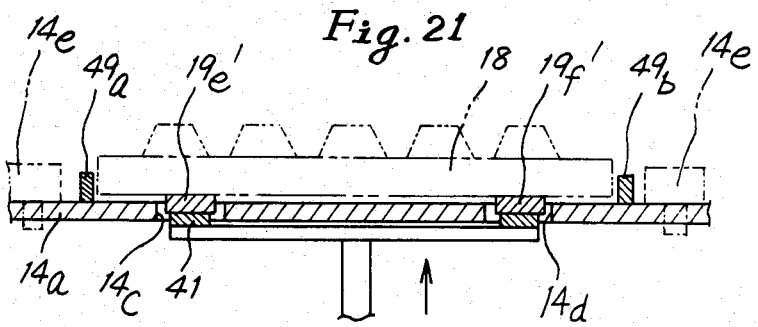
Figure 22:
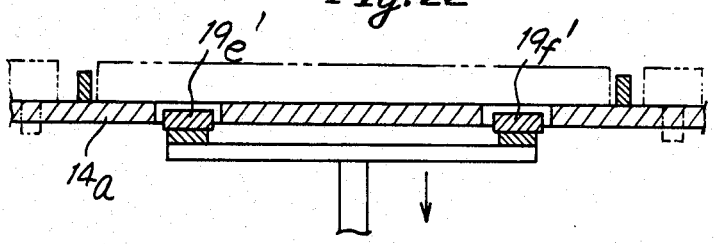

A forward stopper 51 is provided in an opening 52 formed in the support plate 14*a* adjacent the forward end thereof in the running direction of the chains 19*e* and 19*f*. The stopper 51 is vertically movable by a pneumatic cylinder 51*a* between an upper position where it projects above the level of the upper chain portions 19*e'* and 19*f'* as raised or tensioned and a lower position where it is below the level of the horizontal support plate 14*a* (FIG. 18).

Figure 17:
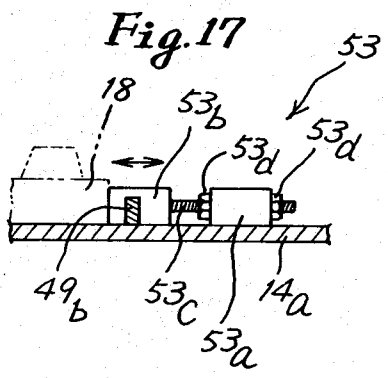
FIGS. 15, 16, 17, 18, 19, 20, 21 and 22 are enlarged views taken along lines A—A, B—B, C—C, D—D, E—E and F—F, in FIG. 13.
Figure 23:
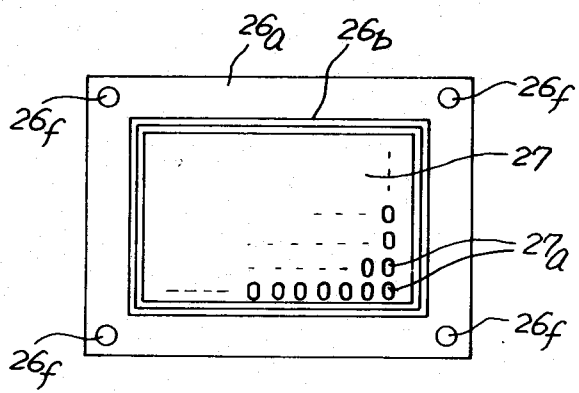
FIG. 23 is an enlarged view taken along line G—G in FIG. 5.

In the intermediate space 50*b* in the guide rail 49*b* there is provided a side stopper 53 which comprises a stationary rear block 53*a* fixed to the upper surface of the horizontal plate 14*a* and a movable front block 53*b* whose position is adjustable by means of bolts 53*c* and nuts 53*d* in the direction perpendicular to the direction of the guide rail 49*b* (FIGS. 13 and 17).

Figure 16:
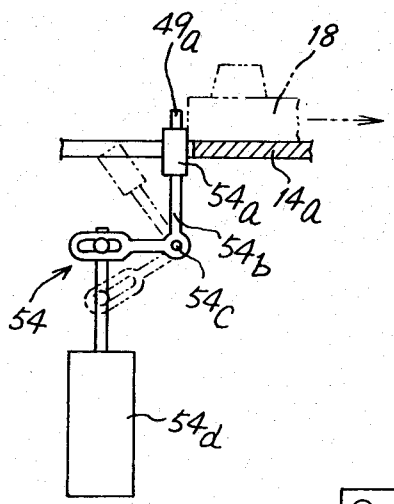
Figure 15:
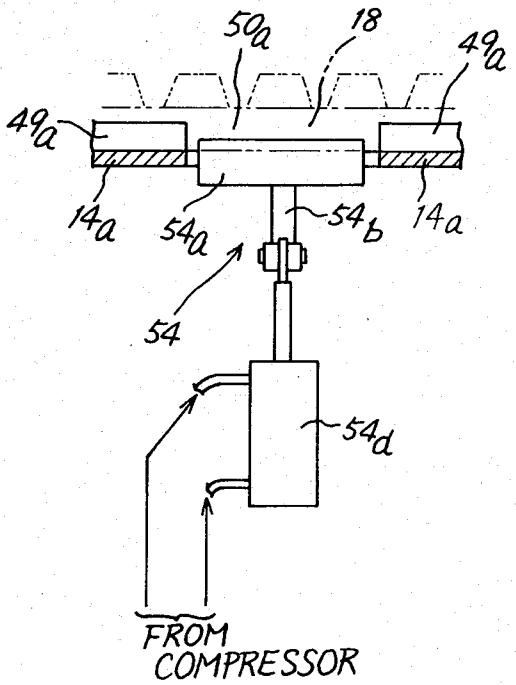

Opposite the side stopper 53 and in the intermediate space 50*a* in the other guide rail 49*a* there is provided a side positioner 54 which, as shown in FIGS. 15 and 16, comprises a push head 54*a*, an L-shaped arm 54*b* pivoted to the machine frame at 54*c* and a pneumatic cylinder 54*d* for driving the head 54*a*. As can be easily seen, when piston rod of the cylinder 54*d* is retracted, the head 54*a* is tilted and lowered, and when the piston rod projects quickly, the head is moved to the upright position thereby to push the key cap holder 18 against the opposite side stopper 53 as will be described presently.

A rear positioner 55 is provided in an opening 56 formed in the support plate 14*a* adjacent the end thereof opposite the forward stopper 51. The rear positioner 55 is of substantially the same construction as the side positioner 54 and comprises a push head 55*a* similar to the push head 54*a* of the side positioner 54, an L-shaped arm and a pneumatic cylinder, the latter two of which are not shown. When the head 55*a* is tilted, it lowers below the level of the horizontal support plate 14*a* and when the head 55*a* is quickly driven to the upright position, it pushes the key cap holder 18 against the forward stopper 51.

As the key cap holder 18 is conveyed by the belts 19*c* and 19*d* out of the housing 21 of the heating section 12, the holder 18 rides on and is carried by the conveyor chains 19*e* and 19*f* of the printing section 14 running in the direction indicated by an arrow W, with the rails 49*a* and 49*b* guiding the holder 18 as far as the forward end of the holder 18 is stopped by the forward stopper 51 projecting above the level of the conveyor chains 19*e* and 19*f* at that time. Then the side and rear positioners 54 and 55 are operated to cause the push heads 54*a* and 55*a* to strike the key cap holder 18 at the lateral and rear sides thereof, respectively, and push the holder 18 against the forward and side stoppers 51 and 53 thereby to put the holder 18 into proper registration with the transfer sheet on the frame 25 just above the holder 18.

The frame 25 is rectangular in shape and has four depending legs 57 each passing downwardly through the horizontal support plate 14*a* so as to be supported by a spring device 58 (FIGS. 5 and 14) so that the frame 25 on top of the legs 57 can be resiliently pushed downwardly as will be described presently.

The frame 25 includes a passage or conduit 25*a* (FIG. 14) to which suction is applied by a vacuum generator 80 through pipes 59. The frame 25 is formed in the upper wall thereof with a plurality of small holes 25*b* communicating with the suction conduit 25*a* in the frame, so that suction is applied through the holes 25*b* to the four edges of a transfer sheet S placed on the frame 25 in the manner to be described presently.

Above the horizontal plate 14*a* there are provided a pair of parallel guide rods 29 extending over and across the conveyor chains 19*e* and 19*f* from one side of the plate 14*a* to the transfer sheet feeding section 13. The transfer sheet carrier 28 is movable along the guide rods 29 between a first position just above a transfer sheet supplier 30 and a second position just above the above-mentioned frame 25 in the printing section (FIGS. 5 to 8). A suitable drive not shown but enclosed in the casing of the carrier 28 drives the carrier 28 until it is stopped by a pair of stoppers 61 above the first position or another pair of stoppers 62 above the second position. The carrier 28 is provided with a plurality of depending suction pads 28*a* to which suction is supplied from the vacuum source 80 through a pipe 28*b*.

A transfer sheet supplier 30 supports a stack of transfer sheets S, and is raised by a suitable device 30*a* such as an air cylinder (FIG. 5), so that the suction pads 28*a* pick up the uppermost transfer sheet S from the stack. The carrier 28 carries the transfer sheet to the position above the frame 25 of the printing section 14, where the carrier 28 releases the transfer sheet, which the frame 25 receives and holds by means of suction appliedd to the sheet through the holes 25*b* formed in the upper surface of the frame 25. The carrier 28 then returns to the original position above the supplier 30 and picks up the next transfer sheet from the stack on the supplier.

Figure 5:
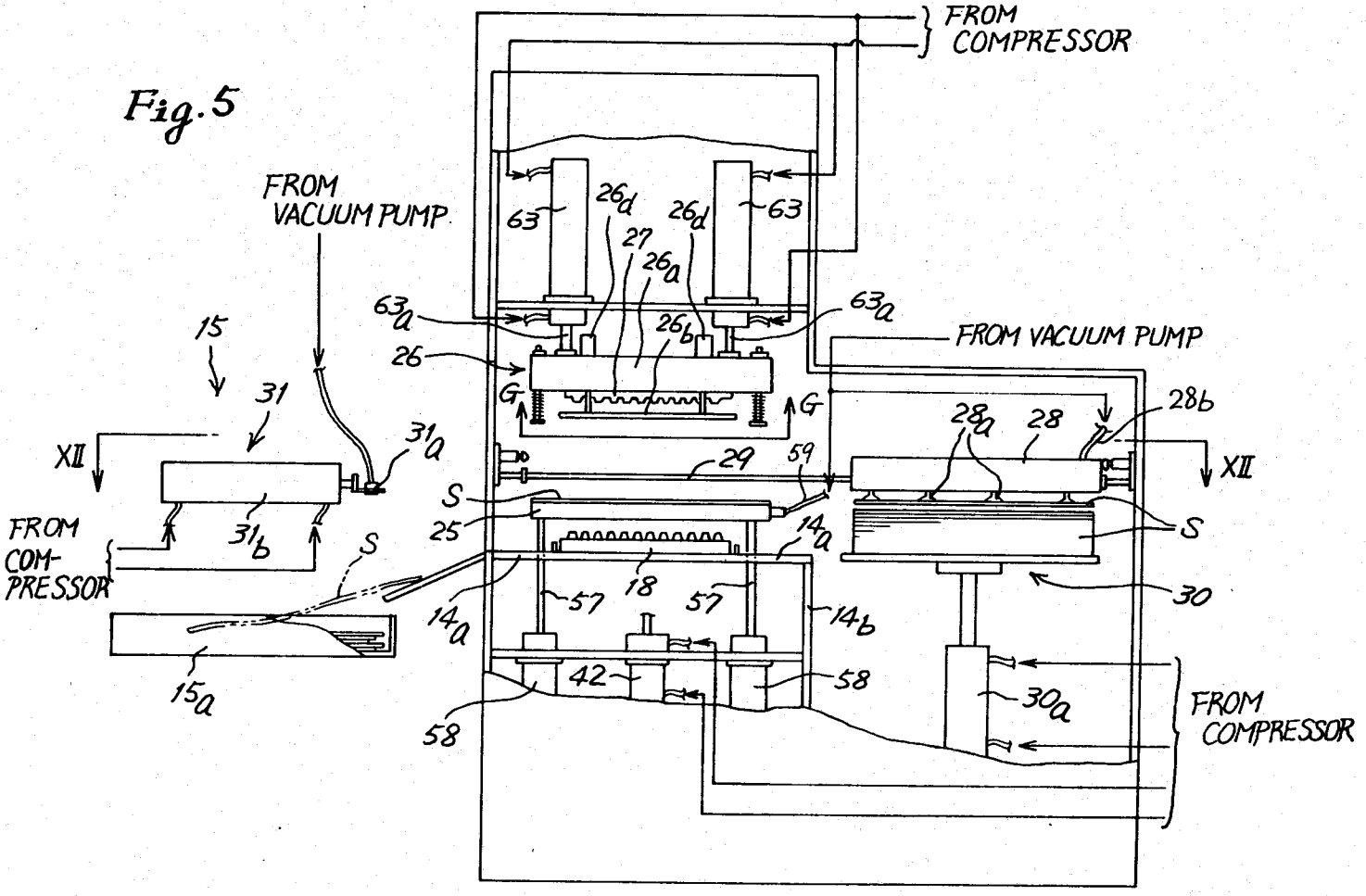
FIG. 5 is a side view of the printing section, the transfer sheet feeding section and the transfer sheet discharging section of the machine shown in FIGS. 3 and 4, with some of the component parts being not shown for simplicity of illustration.
Figure 6:
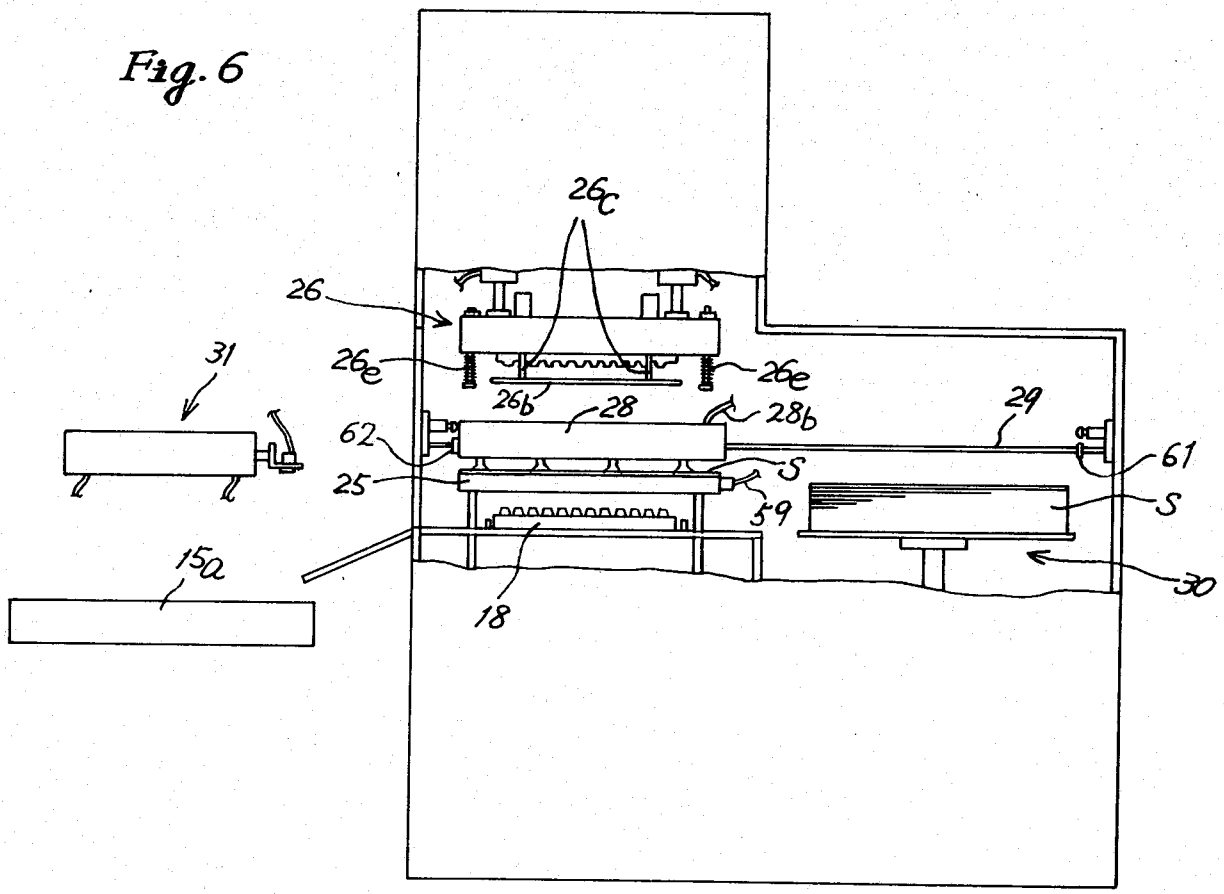
FIGS. 6, 7 and 8 are views similar to FIG. 5 but showing the component parts in different operative positions.
Figure 7:
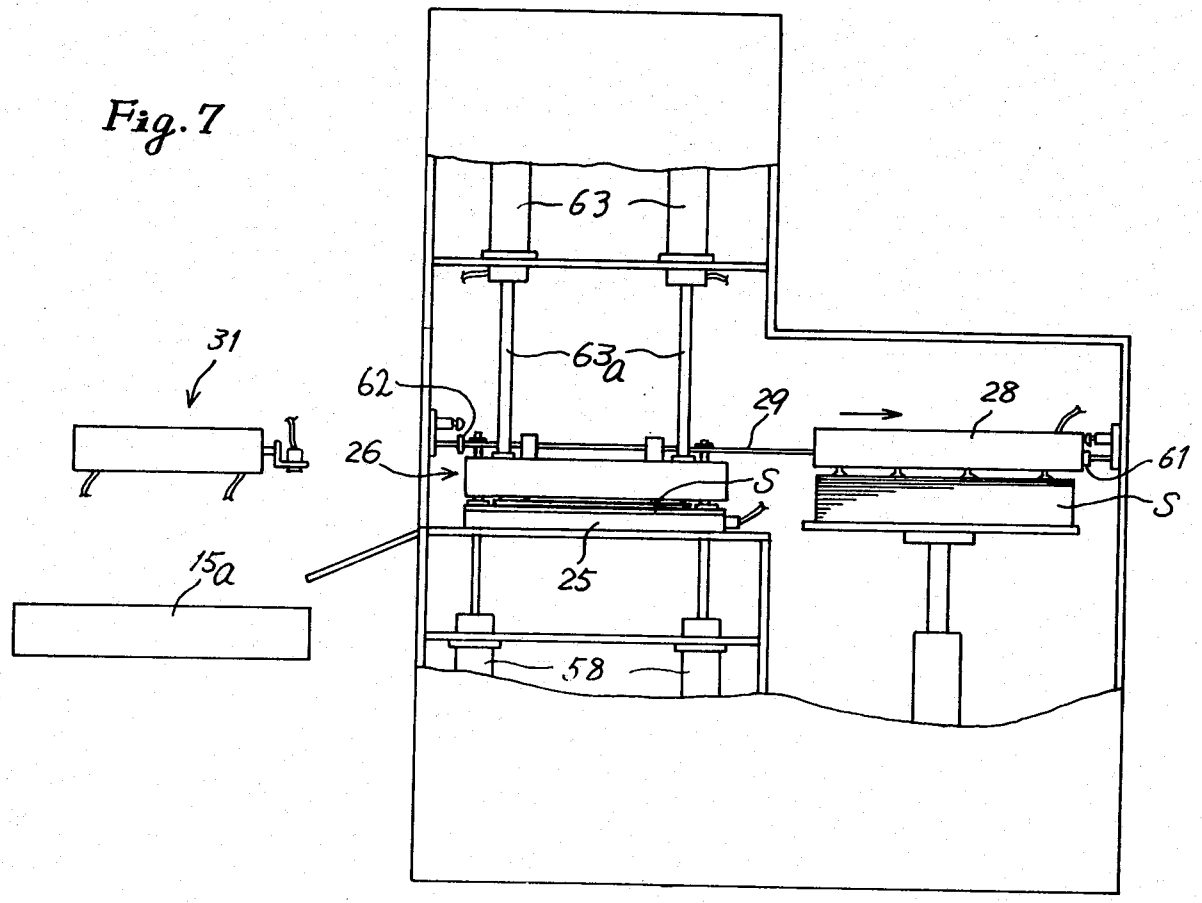
Figure 8:
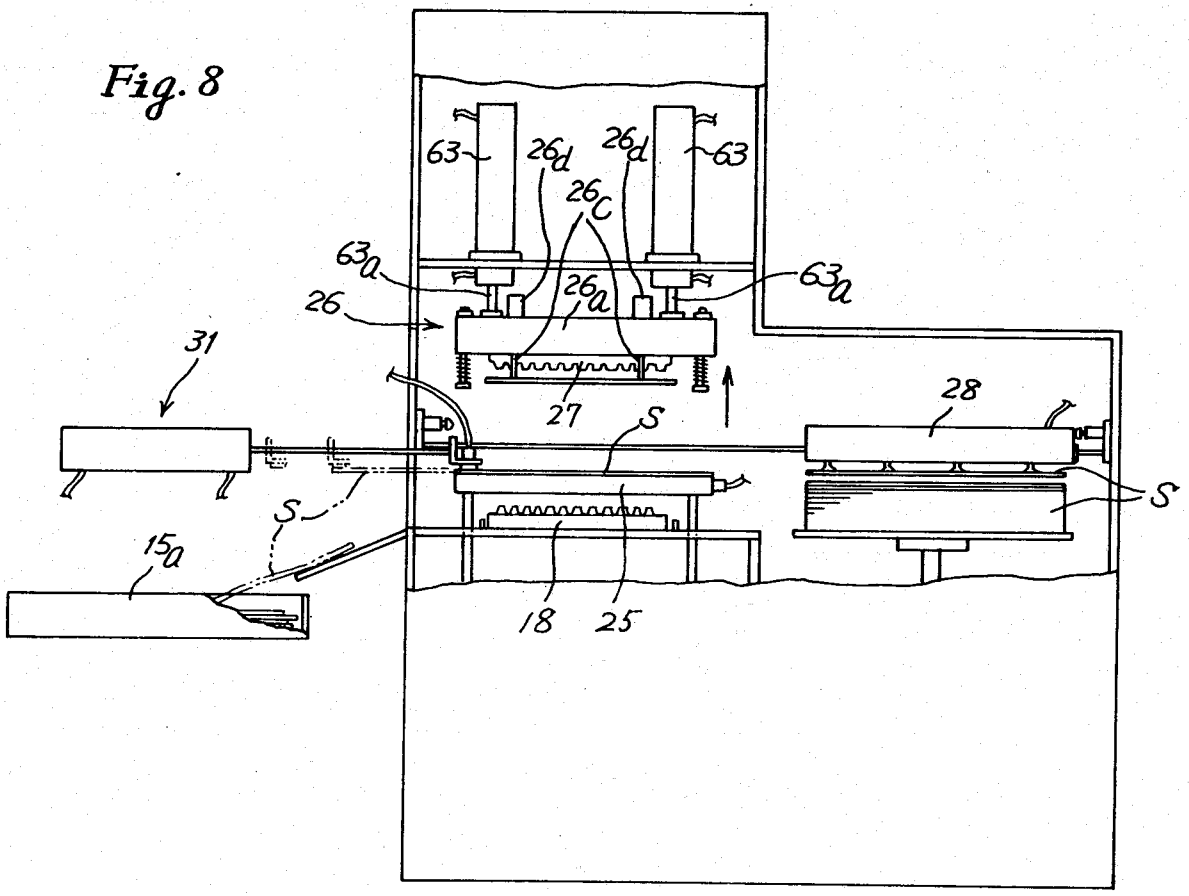
Figure 9:
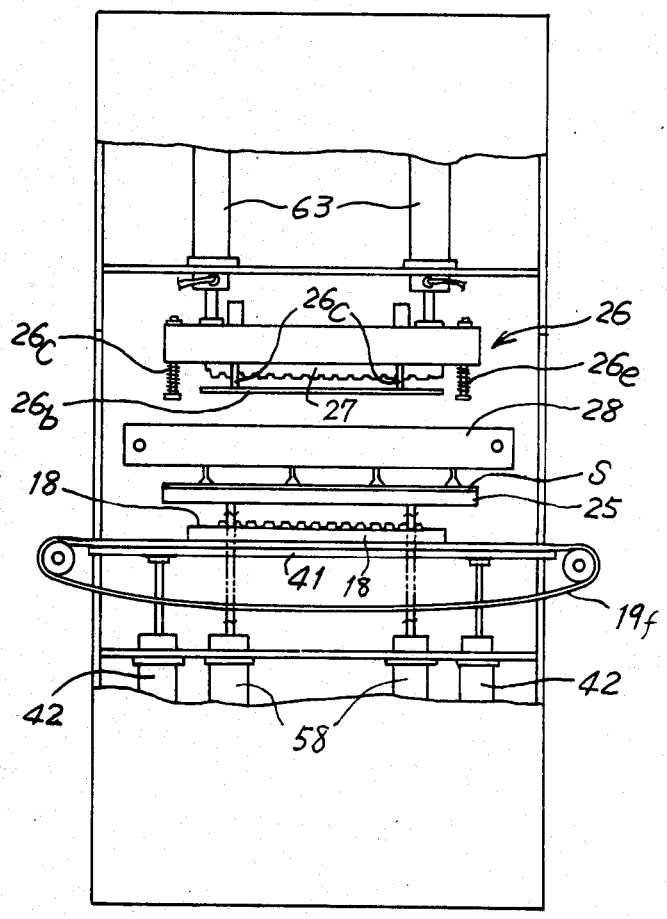
FIG. 9 is a front view of the printing section of the machine shown in FIGS. 3 to 8, with some of the component parts being not shown for simplicity of illustration.
Figure 10:
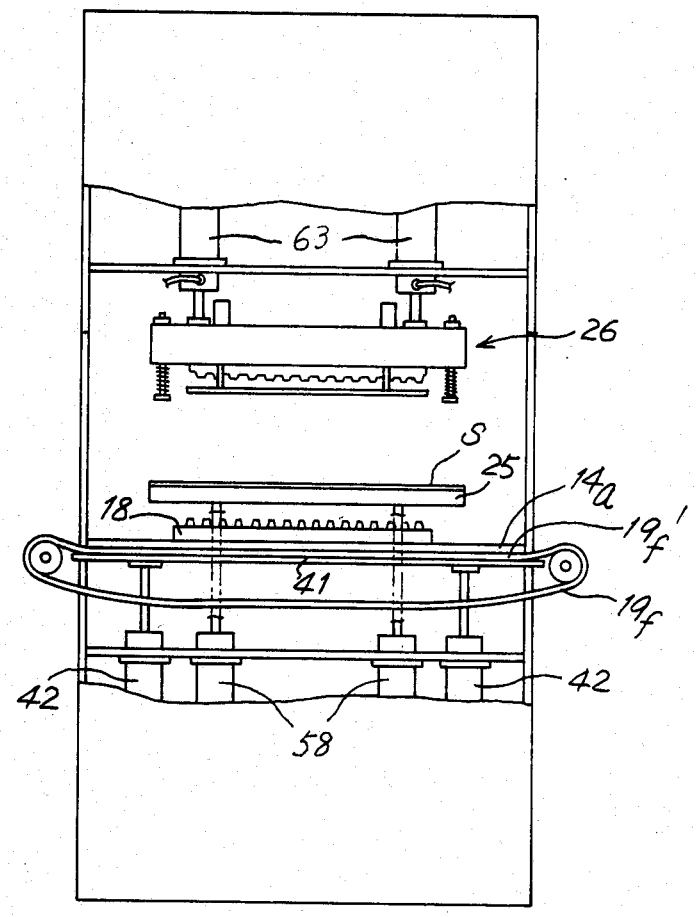
FIGS. 10 and 11 are views similar to FIG. 9 but showing the component parts in different operative positions.
Figure 11:
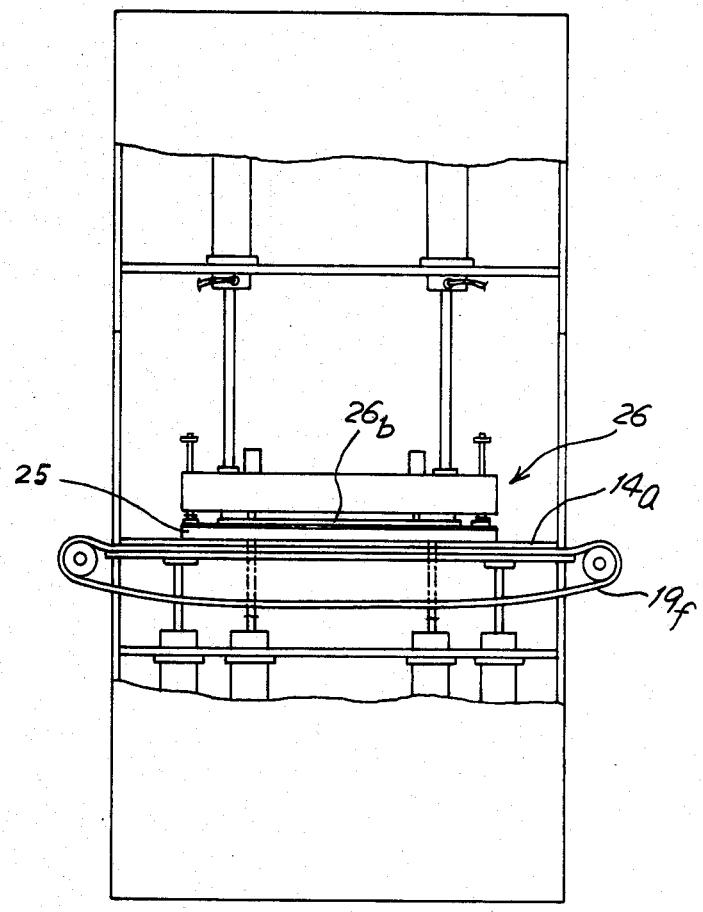
Figure 24:
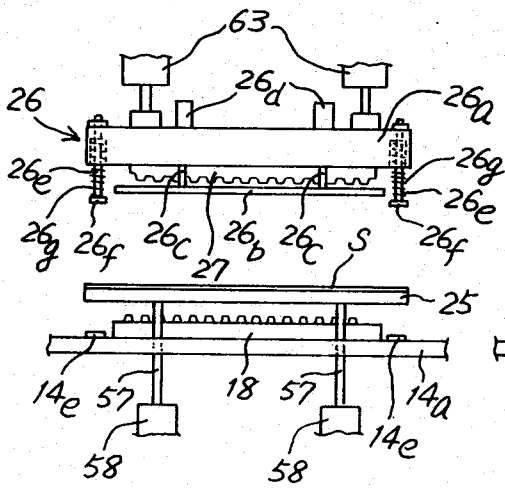

Above the transfer sheet supporting frame 25 the pressing device 26 is supported by two pneumatic cylinders 63 mounted on the machine frame (FIG. 5). Each cylinder has a piston rod 63*a* secured to the upperside of a mounting member 26*a*, to the underside of which a transfer pad 27 is attached removably. A rectangular holding frame 26*b* depends from the mounting member 26*a* by means of four rods, only two of which is shown at 26*c*, so as to be disposed about and normally slightly below the transfer pad 27 (FIG. 24). With each of the rods 26*c* being connected to suitable resilient means 26*d*, the holding frame 26*b* is resiliently yieldable upwardly. The mounting member 26*a* is also provided at the four corners of its underside with four depending rods 26*e* each having its lower end 26*f* normally disposes lightly below the holding frame 26*b* (FIG. 24). The rods 26*e* are provided with a compression coil spring 26*g* and are resiliently yieldable upwardly.

Figure 26:
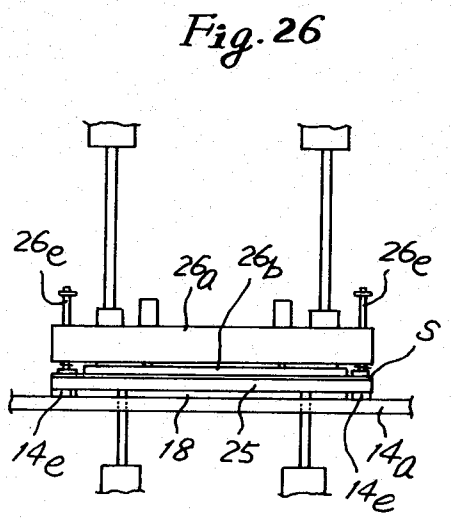
FIGS. 24, 25 and 26 are side views showing successive steps of operation of the pressing device in cooperation with the frame for holding a transfer sheet.
Figure 25:
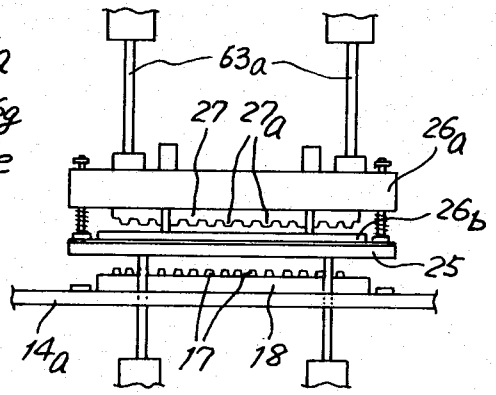

When a transfer sheet S is placed on the frame 25 of the transfer sheet supporting device 24 in the previously mentioned manner, the pressing device 26 is lowered until first the lower ends 26*f* of the four legs 26*e* contact and press the transfer sheet at the four corners thereof onto the frame 25 (FIG. 25) and as the legs 26*e* are resiliently yielded upwardly, the frame 26*b* comes into pressing contact with the transfer sheet adjacent the four edges thereof thereby to securely hold the transfer sheet between the two frames 26*b* and 25 in proper registration with the projections 27*a* of the transfer pad 27 above and the blank key caps 17 below (FIG. 25). As the pressing device 26 is farther lowered, the frame 25 is pushed downwardly until finally the pad projections 27*a* contact the upper or reverse surface of the transfer sheet to press the corresponding figures, letters and/or other symbols on the under or obverse surface of the transfer sheet onto the top surfaces of the blank key caps 17 to effect transfer printing of the images on the key cap surfaces (FIG. 26). Four support members 14*e* are provided on the support plate 14*a* at such positions as to support the frame 25 that has been pushed down in the above-mentioned manner at the four corners thereof. The support members 14*e* are of such a height above the plate 14*a* as to keep the under surface of the frame 25 out of contact with the guide rails 49*a*, 49*b*, the stoppers 51, 53 and the push heads 54*a*, 55*a* while assuring pressing contact of the transfer sheet on the frame 25 with the top surfaces of the key caps in the holder 18. There may be provided several sets of support members of different heights for selective use with key caps of different sizes or heights.

When the transfer printing has been completed, the pressing device 26 is raised so that the frame 26*b* and the legs 26*e* are restored to their original lower position while the frame 25 is restored to its original raised position thereby to separate the used transfer sheet from the key caps 17 onto which the images on the transfer sheet have been transferred.

The key cap holder 18 with the printed key caps therein is then conveyed from the printing section 14 to the article unloading section 16 by lowering the forward stopper 51 and raising the conveyor chains 19*e* and 19*f* into driving contact with the bottom surface of the key cap holder 18.

In the unloading section 16 there is provided a conveyor system similar to that provided in the heating section 12, and the same reference numerals or symbols with a prime designate corresponding members. The conveyor belts 19*c*′ and 19*d*′ at their raised position receive the key cap holder 18 being conveyed from the printing section 14 and convey the holder as far as the holder is stopped by a stopper 64 (FIG. 3), whereupon the belts 19*c*′ and 19*d*′ are lowered to place the holder 18 on the conveyor belts 19*a*′ and 19*b*′, which carry the holder leftward in FIG. 3.

The transfer sheet discharging section 15 is provided at the side of the printing section 14 opposite the transfer sheet feeding section 13. The remover 13 is provided with a suction device 31*a* and a pneumatic cylinder 31*b* for projecting and retracting the suction device. When projected, the suction device 31*a* is positioned slightly above one edge of the used transfer sheet S still held on the frame 25, so that with the frame 25 having been disconnected from the source of vacuum 80, the suction device 31*a* picks up the transfer sheet from the frame 25. As the piston rod of the cylinder 31*b* is retracted, the suction device 31*a* carries the transfer sheet away and releases it into the receptacle 15*a*, thereby completing one cycle of operation of transfer printing.

The above operation is conducted on one key cap holder after another supplied from the loading section 11, with a controller 65 controlling the electromagnetic valves 66*a* through 66*q* and the motor 47 in timed sequence in accordance with a predetermined program. A compressor 90 supplies compressed air to the cylinders provided in the machine.

Figure 27:
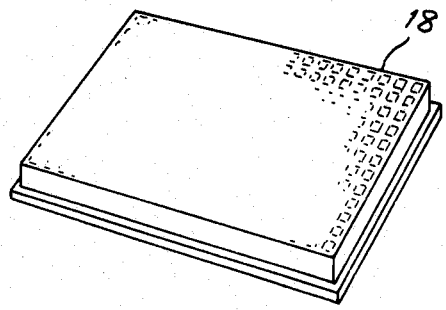
FIG. 27 is a somewhat schematic perspective view of a key cap holder used in the machine of the invention.
Figure 28:
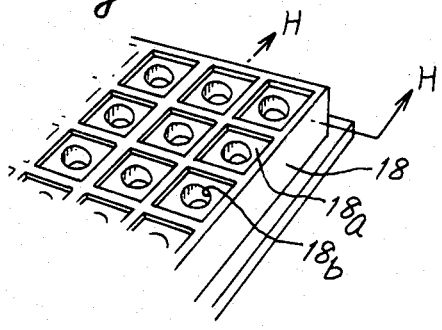
FIG. 28 is an enlarged view of a part of the key cap holder.
Figure 29:
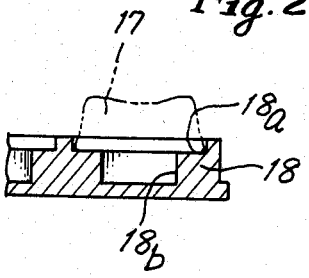
FIG. 29 is a sectional view taken along line H—H in FIG. 28.

FIGS. 27, 28 and 29 show a key cap holder 18 particularly suitable for use in the transfer printing machine of the invention. As previously mentioned, the holder is made of a material which does not substantially expand when heated.

The holder is formed in the upper surface thereof with a plurality of recesses 18*a* of the same or different shapes and sizes in accordance with the shapes and sizes of the key caps 17 to be put in the recesses. A central cylindrical hole 18*b* is preferably formed in the bottom of each recess 18*a* to reduce the amount of the metal and consequently the weight of the holder.

Figure 30:
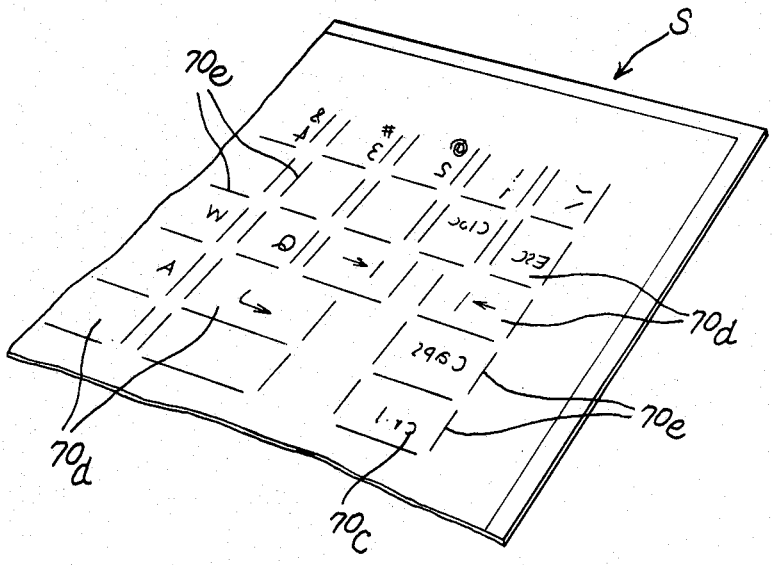
FIG. 30 is a perspective view of a part of the transfer sheet used with the machine of the invention.
Figure 31:
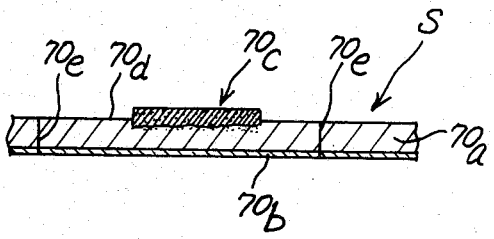
FIG. 31 is a schematic, microscopically enlarged sectional view of the transfer sheet down in FIG. 30.
Figure 32:
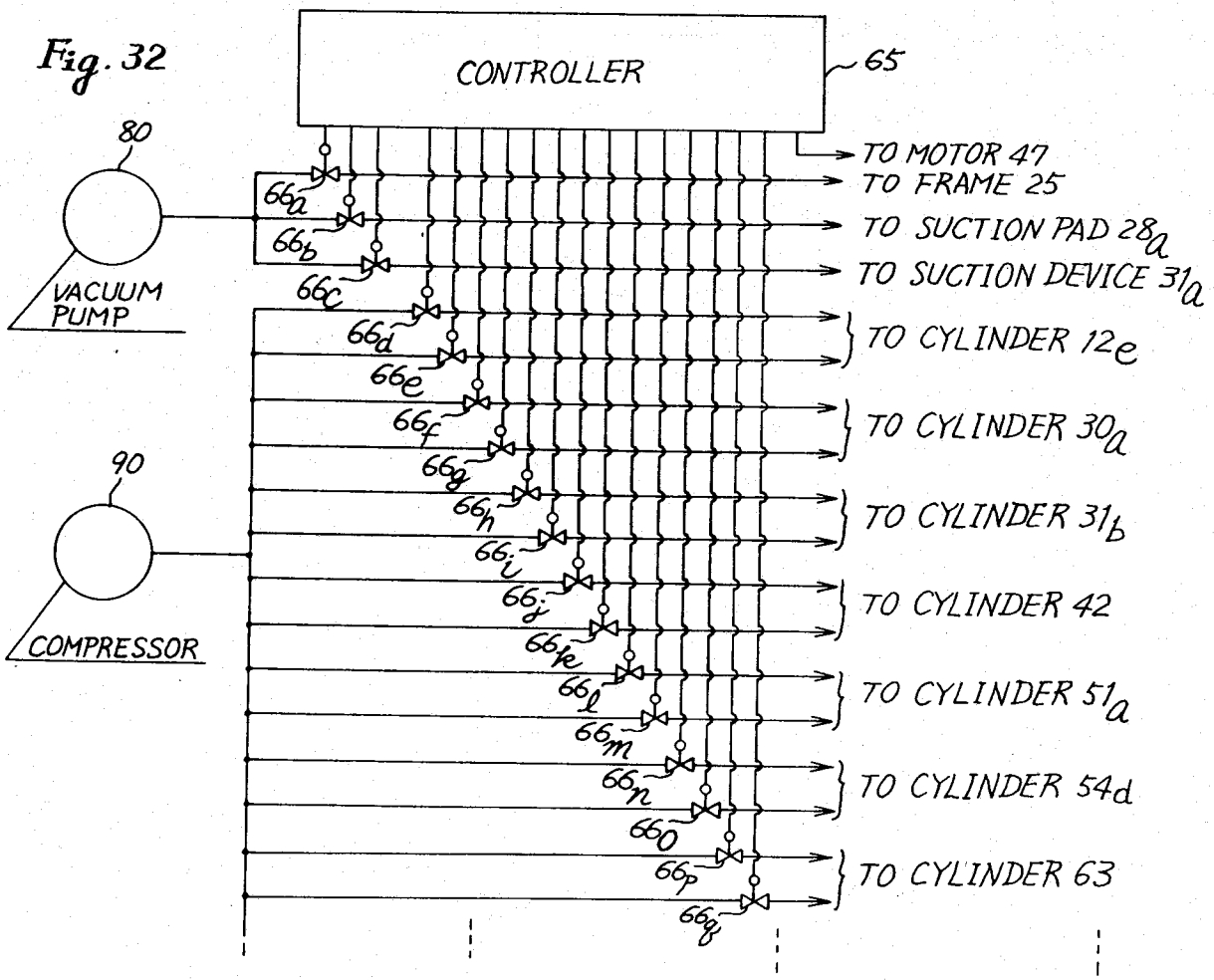
FIG. 32 diagramatically shows a circuit for controlling the cylinders and suction devices in the machine of the invention.

FIGS. 30 and 31 show a transfer sheet S particularly suitable for use in the machine of the invention. The transfer sheet comprises a substrate 70*a* of paper 50 μm to 60 μm thick backed with a foil 70*b* of aluminium 5 μm to 6 μm thick, and a pattern layer 70*c* formed on the upper surface of the substrate 70*a* with a mixture of thermo-diffusible dye or dyes and a binder. Microscopically, some of the mixture has penetrated into the surface of the substrate 70*a*. The transfer sheet has as many small square and/or rectangular areas or sections 70*d* as there are key caps to be transfer-printed, each section 70*d* corresponding to one of the key caps and having a pattern layer comprising a symbol or design to be trnasferred onto the corresponding key cap and being defined at four sides by a slit or cut 70*e*. The provision of slits or cuts 70*e* to define each of the sections 70*d* on the transfer sheet helps the projections 27*a* on the pressure pad 27 when pressed onto the transfer sheet to press the corresponding sections 70*d* into closer contact with the top surfaces of the key caps thereby to enable accurate transfer printing of the pattern or image onto the key caps. The pattern layer on the section 70*d* may also comprise a square or rectangular shape covering the whole surface area of the section and consequently the whole top surface of the key cap.

What we claim is:

1. An apparatus for transfer printing, comprising:

an article holder for holding a plurality of articles to be transfer-printed arranged on a plane in rows, said article holder being made of a material which does not substantially expand when heated;

heating means for heating said articles, said heating means comprising a housing having an inlet opening and an outlet opening, a first conveyor for conveying said article holder from said inlet opening to said outlet opening, and an infrared radiation heater provided inside said housing to heat said articles held in said article holder, without substantial expansion of said article holder, as said articles are conveyed through said housing;

first holding means for holding said article holder at a predetermined first position for a predetermined period of time for transfer printing to be effected on said articles in said article holder, said first holding means comprising a second conveyor for conveying said article holder received from said first conveyor of said heating means, means for temporarily stopping said article holder as it is conveyed by said second conveyor, and means for positioning said article holder accurately at said first position;

second holding means for holding a transfer sheet at a predetermined second position corresponding to said first position, said transfer sheet having a pattern layer formed with thermo-diffusible dye, said second holding means comprising a first frame disposed at said second position above said first position for supporting a transfer sheet above said articles in said article holder positioned at said first position, said first frame being yieldable downwardly so as to enable close contact between said pattern layer of said transfer sheet and the upper surfaces of said articles in said article holder;

means for pressing said transfer sheet against said articles so that said pattern is transfer-printed on said articles; and means for conveying said article holder through said heating means and said first holding means.

2. The apparatus of claim 1, wherein said first frame holds said transfer sheet by suction.

3. The apparatus of claim 1, wherein said stopping means comprises a first stopper so arranged adjacent the forward end of said first position as to be selectively put into and out of the way of said article holder being conveyed by said second conveyor, and means for selectively bringing said second conveyor into and out of driving contact with said holder.

4. The apparatus of claim 3, wherein said positioning means comprises a first movable member provided adjacent the rear end of said first position, means for driving said first movable member so as to push said holder stopped at said first position against said first stopper, a second stopper arranged adjacent one lateral side of said first position, a second movable member provided adjacent the other lateral side of said first position opposite said one lateral side thereof, and means for driving said second movable member so as to push said holder against said second stopper, whereby said first and second movable members cooperate with each other and with said first and second stoppers to position said holder accurately at said first position.

5. The apparatus of claim 1, wherein said pressing means includes a pressing pad, a member for removably holding said pressing pad to face downward, and means for moving said member so as to press said pressing pad against said transfer sheet held on said first frame thereby to bring said pattern layer in close pressing contact with the surface of said articles in said holder.

6. The apparatus of claim 5, wherein said pressing means further includes a second frame so arranged about and below said pressing pad as to be yieldable upwardly upon pressing contact with said first frame of said second holding means thereby to allow said pressing pad to contact and press said transfer sheet against said articles, with said transfer sheet being securely held between said first and second frames.

7. The apparatus of claim 5, wherein said pressing means further includes means for heating said pressing pad.

8. The apparatus of claim 1, further including means for supplying a transfer sheet onto said transfer sheet holding means.

9. The apparatus of claim 1, further including means for removing said transfer sheet from said transfer sheet holding means after transfer printing with said transfer sheet has been completed.

10. The apparatus of claim 1, wherein said article holder holds blank key caps for typewriter-type keyboards.

11. The apparatus of claim 1, wherein said articles are blank key caps for typewriter-type keyboards, and said pattern layer of said transfer sheet comprises one or more symbols and/or one or more designs to be transfer-printed on said blank key caps.

12. In a method of transfer printing a design to work which is supported by a work holder by providing a transfer sheet with said design imprinted thereon with a thermo-diffusible dye and heating said work sufficiently for transfer of said design to said work during engagement between said transfer sheet and said work, the improvement comprising the step of;

preventing intolerable lateral displacement of said design from a preferred print position on said work, by providing that said work holder does not substantially expand to result in said work displacing within said holder, in response to said heating and prior to said transfer.

13. The improvement of claim 12, and further comprising the step of:

heating said work primarily by infrared radiation.

14. The improvement of claim 13, and further comprising the step of:

reflecting said infrared radiation from said work holder during heating of said work in order to limit heating expansion of said work holder.

15. An apparatus for effecting a method of transfer printing a design to work which is supported by a work holder by providing a transfer sheet having said design imprintd thereon with a thermo-diffusible dye and heating said work sufficiently for transfer of said design to said work during engagement between said transfer sheet and said work, the improvement comprising;

means for preventing intolerable lateral displacement of said design from a preferred print position on said work, by providing that said work holder does not substantially expand to result in said work displacing within said holder, in response to said heating and prior to said transfer.

16. The improvement of claim 15, and further comprising:

means for heating said work by infrared radiation.

17. The improvement of claim 16, and further comprising:

means for reflecting said infrared radiation from said work holder during heating of said work in order to limit heating expansion of said work holder.

18. The improvement of claim 17, wherein said transfer printing comprises:

means for printing by sublimation.

* * * * *